United States Patent [19]

Haney et al.

[11] Patent Number: 4,736,954

[45] Date of Patent: Apr. 12, 1988

[54] QUESTION AND ANSWER GAME

[75] Inventors: Christopher Haney, Bolton, Ontario; Taylor Crandall, Toronto, Ontario, both of Canada

[73] Assignee: Horn Abbot Ltd., Canada

[21] Appl. No.: 838,455

[22] Filed: Mar. 11, 1986

[51] Int. Cl.[4] ..... A63F 3/00; A63F 9/04

[52] U.S. Cl. ..... 273/236; 273/288; 273/146; 273/DIG. 26

[58] Field of Search ..... 273/236, 243, 248, 249, 273/250, 251, 253, 288, 148 R, 254

[56] References Cited

U.S. PATENT DOCUMENTS

| | | | |
|---|---|---|---|
| 2,177,790 | 10/1939 | Scott | 273/236 |
| 3,939,578 | 2/1976 | Coffey | 273/243 |
| 4,029,321 | 6/1977 | Lang | 273/236 |
| 4,607,848 | 8/1986 | Maguire et al. | 273/269 |

OTHER PUBLICATIONS

Trivial Pursuit, Rules of Play, Selchow & Righter, 1981.

*Primary Examiner*—Richard C. Pinkham
*Assistant Examiner*—Benjamin Layno
*Attorney, Agent, or Firm*—Jones, Day, Reavis & Pogue

[57] ABSTRACT

A question and answer game which requires a coded reference surface having a depiction thereon, preferrably in the form of a map is taught. The reference surface is subdividable by a coded cell-type network. The players correctly answer different questions provided on cards by identifying the appropriate coded area on the depiction with the answers to the questions appropriately associated therewith. The individual cells of the network are further dividable by a separate lens-type member having division lines thereon defining further coded areas. In this way, the answer accuracy may be increased and the depiction is not unduly cluttered.

19 Claims, 4 Drawing Sheets

FIG. 5a.
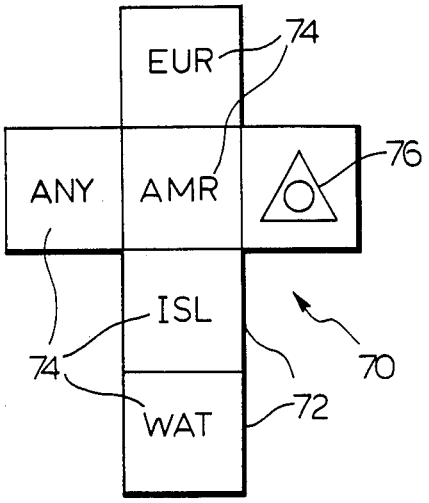
FIG. 5b.
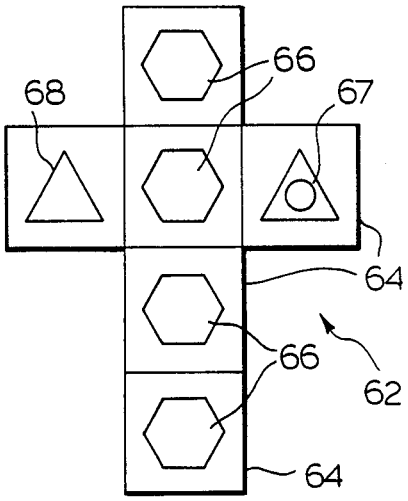
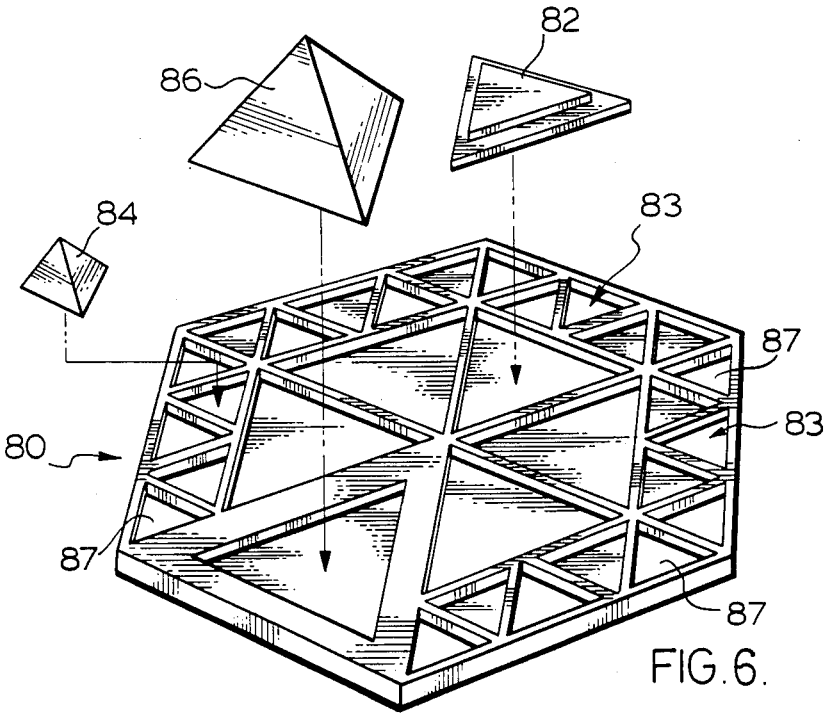
FIG. 6.

QUESTION AND ANSWER GAME

BACKGROUND OF THE INVENTION

The present invention relates to games and in particular, relates to a question and answer game which uses a reference surface.

A number of geographical board games have been proposed to provide both education and entertainment value. Examples of board games which utilize a map include U.S. Pat. No. 3,947,038; U.S. Pat. No. 4,097,051; U.S. Pat. No. 1,665,516 and U.S. Pat. No. 4,441,718. Generally, these games include some sort of grid network superimposed on the map and players move about the map in a manner determined by the rules of the game.

Other games such as those marketed under the Trade Mark TRIVAL PURSUIT are a question and answer game which involve a playing board and scoring pieces for recording player performance. The game board is used to determine the question category for a particular player's turn.

SUMMARY OF THE INVENTION

According to the present invention, a new game is proposed which has a reference surface with a depiction thereon subdividable by a cell-type network. Preferrably, the depiction is of a known geographical region. A code is associated with each cell of the network. A plurality of cards are provided having questions on one face and preferably having answers to the questions on the opposite face. The answer to the question is a particular location on the reference surface and the player must identify the code of the cell containing this location to correctly answer the question. In a preferred embodiment, the correct answer also includes a more specific division of the cell, thus requiring a higher degree of accuracy, and the rules of the game determine what accuracy is required to answer a certain question.

According to an aspect of the invention, first chance means preferably in the form of a six sided die, has a symbol on a face thereof representing one of 5 categories, with the sixth face representing a wildcard. A second chance means may be provided preferably in the form of a die to determine the accuracy to which the question must be correctly answered, either the accuracy of the particular cell of the grid in which the answer to the question is located or a further subdivision of that cell. Each player starts his turn by using the chance means to determine what question category is to be used, and what answer accuracy is required. A card is then selected and the player must answer the appropriate question by identifying at least a cell by code.

From the above, it can be appreciated that questions will be posed and answers to the questions provided with the game requiring the player to identify a particular coded area on the reference surface which would have the answer to the question located therein. In addition, a textual answer to the question may be provided on the card.

BRIEF DESCRIPTION OF THE DRAWINGS

Preferred embodiments of the invention are shown in the drawings wherein;

FIGS. 5*a* and 5*b* are representations of a pair of dice showing the various faces thereof;

FIG. 6 is a partial perspective view of various scoring pieces, and a score holder;

DETAILED DESCRIPTION OF THE PREFERRED EMBODIMENT

Figure 1:
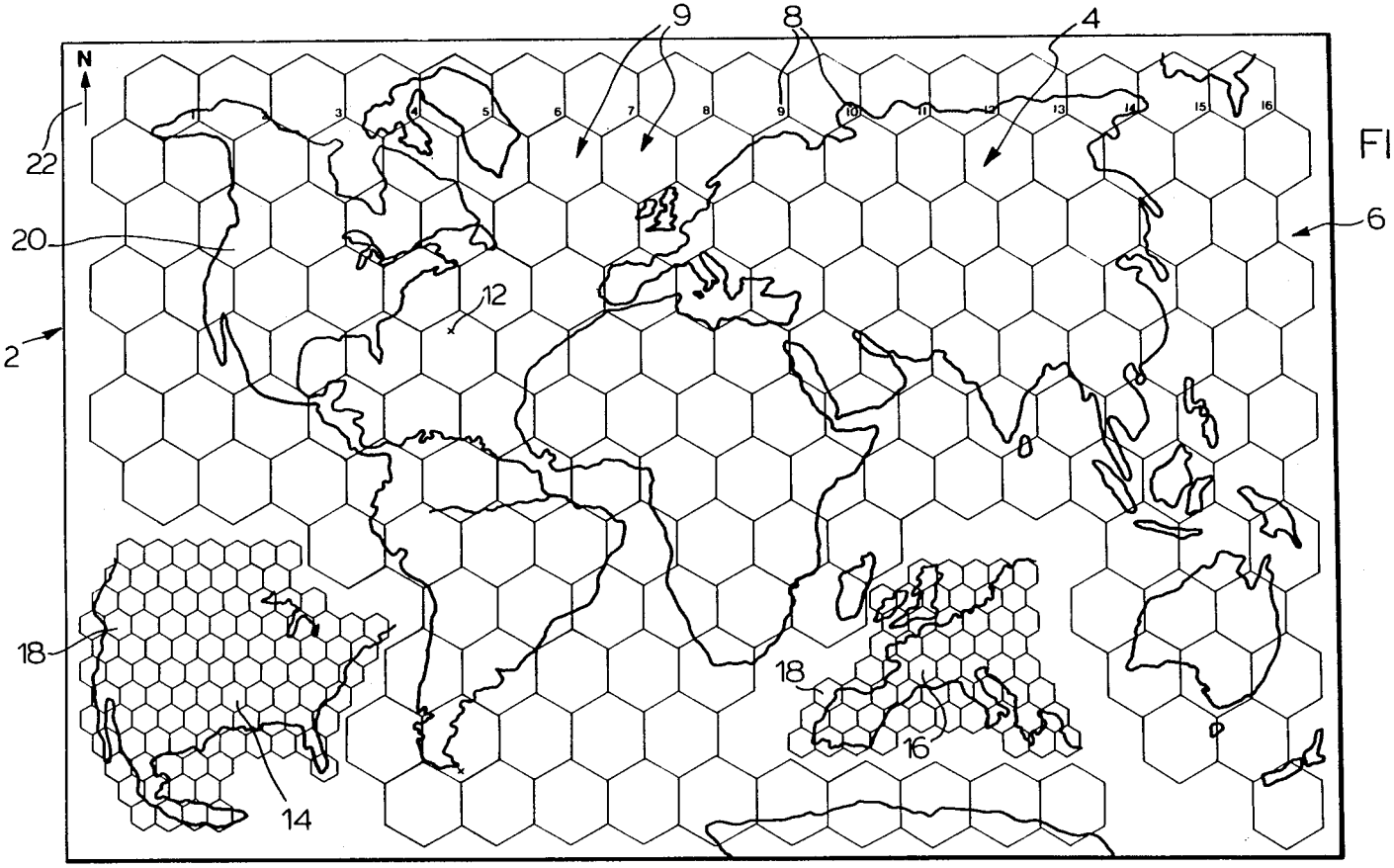
FIG. 1 is a top view of a reference surface.

The reference surface generally shown as 2 in FIG. 1, includes a depiction or representation of a known region, in this case the outline of a map of the world or a substantial portion thereof, generally indicated as 4. A hexagonal cell network 6 has been superimposed over the depiction 4. A code 8 is associated with each hexagonal cell 9, whereby each cell 9, can be identified by code. The questions of the game are divided into categories. In the embodiment shown in the drawings, the continents of North America and South America are one category and the remaining four categories are Europe, Water, Islands and Anywhere which may include shipwrecks, other points of interest, or any of the categories. One such point of interest is identified by item 12, in this case a shipwreck.

The above categories are preferred, however, it is anticipated the categories will change depending upon the market being pursued.

The reference surface may include expert areas designated as 14 and 16, which preferably include a larger scale map of one of the categories or a portion of one of the categories with a smaller scale hexagonal cell network associated therewith. In this way, the accuracy to which the question must be answered is significantly increased. These expert reference surfaces are preferably located on the same reference surface in a manner not to interfere with the normal play of the game. In some cases, the player may have significant knowledge of a particular area and he may prefer, or other players may prefer that he use the expert area when that particular question category or portion thereof is selected. The rules of the game may determine when these expert areas are used and these expert areas can be used for purposes other than handicapping.

Figure 2:
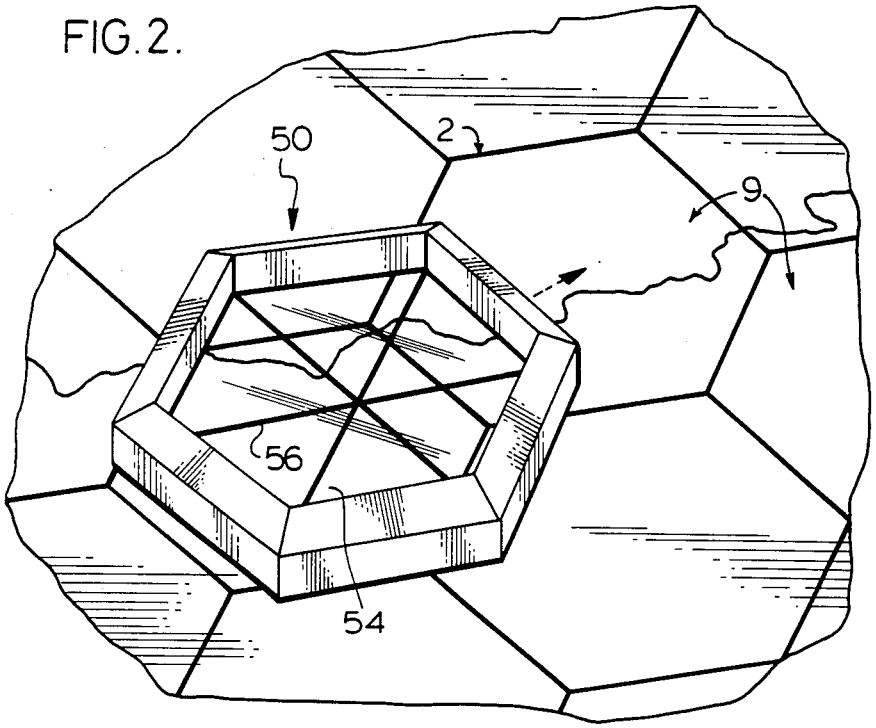
FIG. 2 is a partial perspective view of a portion of the reference surface with a device for subdividing each cell of the network into smaller divisions placed thereon.
Figure 3:
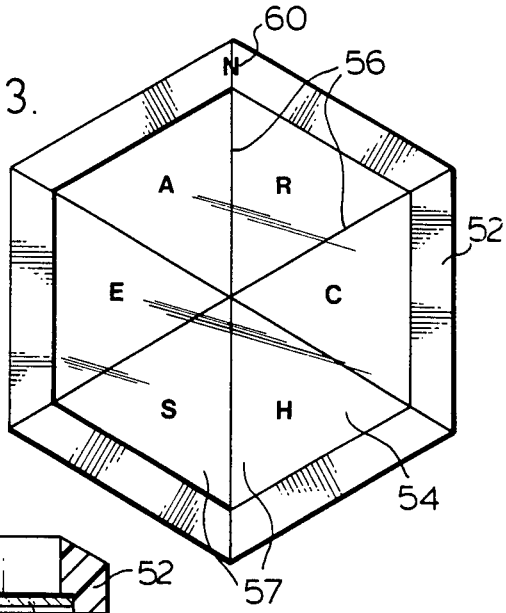
FIG. 3 is a top view of the subdividing device.
Figure 4:
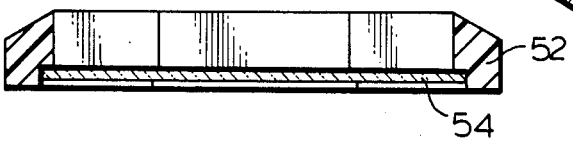
FIG. 4 is a sectional view through the subdividing device.

The map 4 includes a direction indicator 22, for use with the subdivider 50 shown in FIG. 2. This subdivider is movable about the reference surface for subdividing of cells. It includes a hexagonal frame 52 for supporting a transparent inset 54 having etched dividing lines 56 thereon to define the triangle regions 57. An alphabetic code 58 is associated with each of these triangles 57. The subdivider 50 is placed on the playing surface, such that the direction indicator 60 of the subdivider aligns with the direction indicator 22 on a playing surface to thereby predetermine the orientation of the subdivider 50 on the hexagonal cell network 6. The alphabetic code associated with each triangle 57 is used if triangle accuracy is required to answer the question. Triangle accuracy requires the player when answering a question, to identify the hexagonal cell as well as the particular triangle of that hexagonal cell when divided by the subdivider 50.

Figure 7:
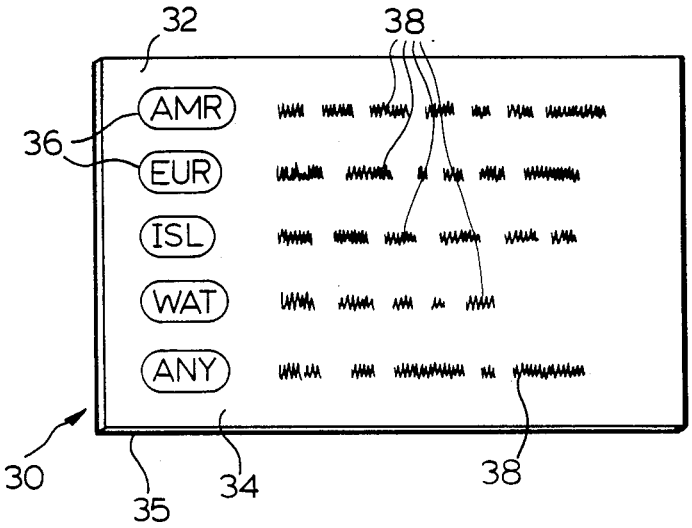
FIG. 7 is a partial perspective view of the front face of the question and answer card.
Figure 8:
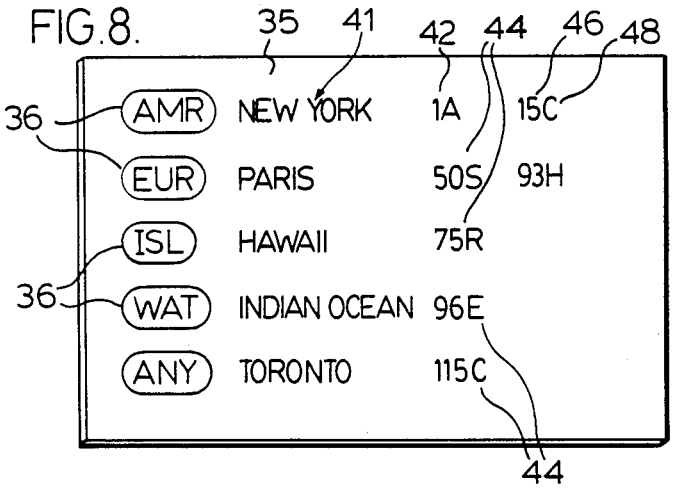
FIG. 8 is a bottom view of the question and answer card showing the coded answers on the surface thereof.

A plurality of cards are provided with one such card shown in FIG. 7. Each card has a number of questions 38 on the front face 32 of the card as shown in FIGS. 7 and 8. Each question is associated with one of the five categories preferably having a code 36 having both a designated colour code and the letter code AMR, EUR, WAT, ISL, or ANY. The preferred colours for the codes are red, green, grey, yellow and blue. Thus the front face of the card identifies a question for a particular category on the front face 32, and on the rear face 35 answers are provided associated with each category, generally indicated by the colour code and letter code associated with such category. In this case, each category includes a textual answer 41, followed by a numeric code 42, which represents the code of the individual cell representing the right answer and a alphabetic code 44 representing the triangle accuracy of the answer as discussed previously. A further answer may or may not follow indicated by numeric code 46 followed by the triangle accuracy indicated by 48 for the expert reference surface. Therefore, the question 38 associated with a given category will include the textual and code answer associated with the large reference surface, and where applicable an answer associated with an expert reference surface. It can be appreciated that not all questions need include an answer for an expert reference surface.

Dice are shown in FIG. 5 with the first die 70 having six faces 72, having category codes 74 on five of the faces. Each category code is associated with a single face 72. In addition, a triangle and circle symbol representing "a wildcard" is provided on the sixth face and is indicated by item 76. According to the rules, a player who rolls the "wildcard" may pick the question category of his choice. The second die generally shown as 62, has six faces indicated by 64 and includes 4 hexagonal representations 66. In addition, one triangle representation 68 is present, requiring a triangle accuracy answer. The remaining face of die 62 has a different designation 67 indicating a "wildcard" which allows the player to choose the accuracy to which the question is to be answered. Die 62 is used to determine the accuracy to which the player must answer a particular question and die 70 determines what question category is to be used for a given turn.

Scoring is provided by answering a question in a particular category according to triangle accuracy, and when correctly answered, scoring pieces 84, each shaped as a tetrahedron and coloured according to the particular category, are placed in the score holder 80. The holder 80 is suitable for up to 5 players or teams of players, each of which has a player marker 82 and an associated scoring cell 83, subdivided into divisions 87 for receiving category scoring pieces 84. Once the player has acquired all category scoring pieces 84 in his cell 83, he must answer a final question, possibly of a category of his choice or a category of the other players choice, depending upon the rules of the game. Upon correctly answering a final question, the ultimate scoring tetrahedron 86 is placed in the holder 80 atop the player marker 82 and ends the game.

As in most games, a particular order for play is adopted after which, each player takes his turn by rolling the die 70 to determine the category and rolling die 62 to determine the accuracy to which the player is to answer the question. A card is then taken from the plurality of cards and a question is addressed to the player based on the determined category. Once the question has been proposed, the player uses the reference surface 2 and selects what he considers to be the correct coded hexagonal, and if triangle accuracy is required by die 62, he would use the subdivider 50 to determine which triangle he believed the answer to the question would be located within. If the question is answered correctly, the player then would take another turn by rolling the dice if the question was answered to hexagonal accuracy, or would place a scoring piece 84 in the score holder 80, if it was answered to triangle accuracy correctly, and then take another turn. If the answer is incorrect, the next player starts.

It can be appreciated, other forms of scoring are possible and the present game is not limited by the preferred form of scoring and preferred scoring structure described above. In some circumstances, it may be desirable merely to play the game without keeping score. For example, scoring introduces a competitive factor into the game and may not be desired when the game is used as an educational tool.

The reference surface 2 shown in FIG. 1, need not be in a board format, but could be a folded map where only a portion of the reference surface is unfolded at a time. Such an arrangement makes the reference surface easier to handle, where space is limited and also allows the game to be played on buses etc. This folded reference surface is possible as the reference surface is not used to located playing pieces.

In an alternate embodiment, a simplified version of the game is proposed restricting the question and answer categories to 4, such as Americas, Europe, Water and Anywhere. In this case, the deleted category marking "Island" on the die in FIG. 5*a* would be replaced with a "wildcard" symbol and each scoring cell 83 would have only 4 divisions 87. It can be appreciated the question and answer cards would be amended to the four categories. In this case, the preferred category colours are red, green, yellow and blue.

As illustrated above, the reference surface is unchanged and changes are limited to the cards, dice and possibly scoring components. Such an arrangement provides flexibility for different markets or market segments and provides increased flexibility with respect to after sale improvements.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A game comprising a reference surface depicting at least a part of the world geography and a cell-like network subdividing said reference surface into coded cells having uniform size;

a plurality of questions, each having an answer which is a location within said reference surface;

a plurality of answers associated with said plurality of questions in a manner to identify a coded cell containing the location which correctly answers the given question;

and a first chance means for selecting a region of the reference surface to which the question relates.

2. A game as claimed in claim 1, wherein said plurality of questions are carried on a plurality of cards.

3. A game as claimed in claim 2, wherein said plurality of answers appear on the same card as said plurality of questions.

4. A game as claimed in claim 3, wherein said cards include category markings thereon associating the question with a particular category; and wherein each category is a recognizable region on said reference surface.

5. A game as claimed in claim 4, wherein said questions are divided into at most five categories.

6. A game as claimed in claim 5, wherein said categories each have a separate colour and alphabetic code which forms part of said category markings.

7. A game as claimed in claim 6, wherein the colours used to designate categories are selected from the colour of red, green, orange, yellow and blue.

8. A game as claimed in claim 4, each card containing a colour coded question and answer for each category.

9. A game as claimed in claim 8, including, said selected region being a category for which a player must answer the category question of a selected card.

10. A game comprising a reference surface having a depiction thereon and means associated with said depiction and reference surface subdividing said reference surface into small coded areas;

a plurality of questions, each having an answer which is a location within said depiction and at least partially identified by a code associated with said small coded areas;

a plurality of answers associated with said plurality of questions in a manner to identify at least the correct code of the small coded area containing the location which correctly answers the given question; and means for selectively sub-dividing the coded areas into smaller coded divisions and wherein said answers include the code of the small area as well as the code of the correct smaller division of said small area.

11. A game as claimed in claim 10, including second chance means for determining the accuracy to which a particular question is to be answered, namely the coded area or the coded area and a smaller division thereof.

12. A game as claimed in claim 11, wherein said depiction is substantially a map of the world.

13. A game as claimed in claim 12, wherein said means for subdividing is a hexagonal cell-type network with the small coded means being cells of said network.

14. A game as claimed in claim 12, wherein said reference surface in addition to said map includes at least one additional playing area of increased difficulty associated with one of said categories whereby different players of different abilities can at least partially play on different portions of the same reference surface.

15. A game as claimed in claim 14, wherein said means for selectively dividing is also adapted for use with the at least one additional playing area.

16. A game as claimed in claim 15, wherein said means for selectively dividing is a viewing device adapted to be placed over an individual coded area in a particular manner and including guide lines thereon subdividing the area into said smaller divisions.

17. A game as claimed in claim 16, wherein said first chance means is a six faced die having category marking thereon, each category marking being on a separate face of the die and a wildcard symbol on at least one of the faces.

18. A game as claimed in claim 11, wherein said second chance means is a six faced die with different faces associated with the difficulty to which the question is to be answered.

19. A game comprising a reference surface illustrating a geographic depiction, said reference surface divided into individually identifiable uniformly sized areas;

a plurality of questions requesting a specific location and a plurality of answers to said questions, the questions and answers being categorized by region of the geographic depiction to which they pertain; and means for selectively sub-dividing the uniform areas into smaller identifiable divisions;

wherein the answers identify the location by said uniform areas and by said smaller divisions.

* * * * *